United States Patent [19]

Wood et al.

[11] 4,396,075

[45] Aug. 2, 1983

[54] MULTIPLE BRANCH COMPLETION WITH COMMON DRILLING AND CASING TEMPLATE

[76] Inventors: Edward T. Wood, 3415 Fawn Creek, Kingwood, Tex. 77339; Donald W. Dareing, 13914 Jaycreek Ct., Houston, Tex. 77070; Robert Snyder, 2010 Grove Lake Dr., Kingwood, Tex. 77339; William C. Larson, 8301 Ewing Rd., Bloomington, Minn. 55431

[21] Appl. No.: 276,551

[22] Filed: Jun. 23, 1981

[51] Int. Cl.[3] ..... E21B 7/08; E21B 43/28

[52] U.S. Cl. ..... 175/79; 166/50; 166/117.5; 166/242; 175/61; 299/4

[58] Field of Search ..... 175/61, 62, 79, 80, 175/81; 166/117.5, 50, 52, 297, 242

[56] References Cited

U.S. PATENT DOCUMENTS

| | | | |
|---|---|---|---|
| 1,900,163 | 3/1933 | Dana et al. | 175/61 X |
| 1,900,164 | 3/1933 | Dana et al. | 175/61 |
| 2,797,893 | 7/1957 | McCune et al. | 175/61 X |
| 3,055,349 | 9/1962 | Allen | 166/242 X |
| 3,064,729 | 11/1962 | Lindley | 166/297 |
| 3,116,799 | 1/1964 | Lemons | 175/61 |
| 3,330,349 | 7/1967 | Owsley et al. | 166/117.5 X |
| 4,222,611 | 9/1980 | Larson et al. | 299/4 |
| 4,249,777 | 2/1981 | Morrell et al. | 299/4 |

*Primary Examiner*—Stephen J. Novosad

*Attorney, Agent, or Firm*—Thomas Zack; Donald A. Gardiner

[57] ABSTRACT

A method of drilling and completing multiple branch wells extending from a main generally vertical hole. This invention finds its primary applicability in in situ leach mining of deep (500 to several thousand feet) lying ore bodies such as uranium, copper, etc. Initially, the main generally vertical hole is drilled, cased, and cemented. Whipstock drilling guides are placed to extend downwardly and outwardly from the bottom of the casing for this hole and cemented in place. These guides are the same in number as the branch holes to be drilled. In addition, the well bore casing contains an indexing dog just above the whipstock drilling guide. The actual drilling of the branch wells is accomplished with a floating index collar and a drill bit assembly which runs therewith. The indexing dog is fixed in the main hole and engages the indexing collar so that the drill bit is oriented to drill into one of the whipstock drilling guides. After a particular branchis drilled, the collar and bit are retrieved from the main hole. The bit is then placed in another hole of the collar and the combination reinserted in the main hole where it again engages the indexing dog and allows drilling of another branch well. After all branch wells are drilled, they are cased with a flexible casing, like fiberglass, cemented and selectively perforated. If the well is a liquid recovery well, a pump is placed at the bottom of the main vertical hole casing near where it joins the branch wells.

6 Claims, 6 Drawing Figures

MULTIPLE BRANCH COMPLETION WITH COMMON DRILLING AND CASING TEMPLATE

BACKGROUND OF THE INVENTION

1. Field of the Invention

A method and apparatus to drill multiple branch wells from a main generally vertical hole.

2. Description of the Prior Art

In situ leach mining that employs either a single injection and recovery (producer) well or separate injection and producer wells are known. This invention relates to those types employing separate injection and producer wells wherein each of the injection and/or producer wells may have multiple branches.

The two known closest prior art references dealing with multiple branch wells can be found in U.S. Pat. No. 4,222,611 issued Sept. 16, 1980, to W. C. Larson et al entitled "In-Situ Leach Mining Method Using Branched Single Well for Input and Output," and the U.S. Pat. No. 4,249,777 issued Feb. 10, 1981, to W. C. Larson et al entitled "Method of In-Situ Mining." Each of these references is concerned with an in situ method of leach mining wherein branch wells are drilled from the surface to extend from the bottom of a generally vertical well. In the latter reference, there are rows of separate injection and recovery wells. The U.S. Pat. No. 4,222,611 utilizes a single generally vertical main well which acts as both the injection and recovery well and would not be as relevant hereto as a consequence.

The present invention relates to a refinement of the method set forth in the mentioned invention which uses a series of rows of separate injection and recovery wells. The refinement provides for the use of a template made up as a drilling guide, a floating collar, and an internal indexing dog. This allows the branch wells to be drilled from the surface in the proper direction so that they extend from the lower end of the main cased well. It also allows the branch wells to be cased and cemented so that there is no leakage of the leachant material except at designated perforations in the branches.

SUMMARY OF THE INVENTION

The method and apparatus disclosed relates to a technique and apparatus to drill branch wells from a main generally vertical well. Initially the main hole is drilled. Next, a protective casing with a drilling template is inserted in this hole with the template extending fromm the bottom of the casing. This template has a whipstock drilling guide. Above the guide an internal indexing dog is fixed in the casing. This allows for the positive sequential entry of the bit assembly into the drilling guide. The actual drilling is accomplished by a drill bit assembly and a floating collar. The bit extends through one of the holes of the collar and the collar is keyed to orient itself with the indexing dog. This orientation allows the bit to engage the drilling guide. After each branch well is drilled, the collar and bit are retrieved to the surface by pulling the bit out of the hole and re-keyed for the next branch drilling. Appropriate flexible casings are fixed in each branch, cemented and perforated near their lower ends.

The primary object of this invention is an improved method and apparatus to drill branch wells in the earth as, for example, in situ leach mining.

DESCRIPTION OF THE PREFERRED EMBODIMENT

The work relating to this invention was done under a contract funded by the United States Department of the Interior, Bureau of Mines, with Maurer Engineering Inc. of Houston, Tex. The ASME publication 81-PET-2 entitled "Drilling and Completing Multiple Branched Boreholes for In Situ Leach Mining" first presented and distributed to the public on Jan. 18–22, 1981, describes many of the details relating to this invention. The contents of this publication are specifically incorporated by reference herein.

This invention was developed for deep—over 500 feet and usually several thousand feet—in situ leach mining. Its purpose is to drill multiple branch holes which are cased and leak proof with pressure tight communication throughout the well. One type of pattern these wells can form is a series of parallel rows of producer and recovery wells using a five-spot pattern with fewer well-heads at the surface as detailed in the mentioned invention of W. C. Larson et al entitled "Method of In Situ Leach Mining" now U.S. Pat. No. 4,249,777.

The preferred embodiment to be described relates to a generally vertical well with a protective casing and three branches extending into the ore body. The same principles used to construct the preferred embodiment could apply to two branches or any other number of multiple branches.

Figure 1:
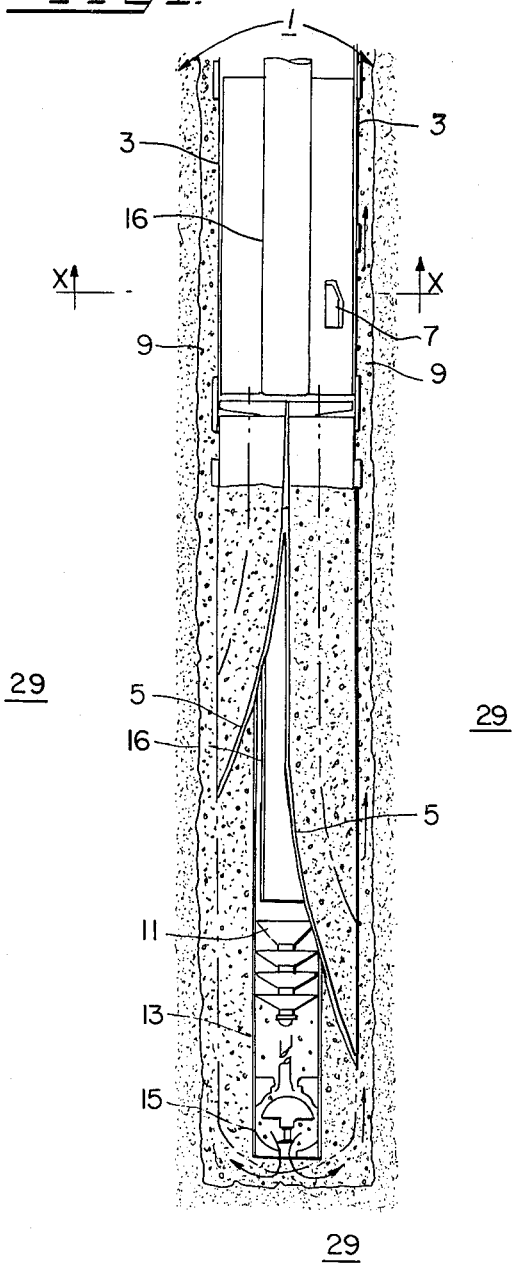
FIG. 1 schematically shows the main well hole with its protective casing and drilling template in place.

FIG. 1 shows the initial well construction stage after several steps have taken place. First, the main generally vertical hole 1 (about 17½ inches in diameter) has been drilled and its walls cased with a protective steel casing 3 that is about 13⅜ inches in diameter. Next, at the lower end of the casing a drilling guide 5 is placed to extend downwardly and outwardly from the casing. This guide is made of three separate metal tubular members—about 6 inches in I.D.—which are oriented to extend from the casing in the directions branch wells are desired. This guide would allow conventional whipstock techniques to be employed in the actual drilling process. Above the guide at the location where it joins the main casing 3, is the indexing dog 7 (see FIG. 2). The purpose of this dog is to insure that the drill bit will end up in the proper whipstock branch by fixing it with respect to the stationary casing 3.

Figure 2:
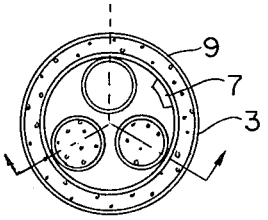
FIG. 2 is the sectional view from lines X—X of FIG. 1.

In its simplest form, the indexing dog can be a trapezoidal plate welded to the inside of the wellbore casing which protrudes towards its center. The indexing dog should be positioned as shown in FIG. 2 so as not to interfere with drill bit entry into any of the three branches. Also, the exact position of the indexing dog relative to the centerlines of the three whipstocks is important. The indexing dog is the reference for selectively reentering a given branch, engages an indentation, hole, etc., on the bottom of a retrievable indexing collar 25 (see FIG. 3).

Except for the vertical branch tube, the entire lower end of the drilling template is precast is cement. It is necessary to plug the other two branch openings so that standard casing cement practices can be used to cement the entire casing in the well bore. These precast cement plugs will be drilling out during the branch drilling operation.

A cement plug 11, vertical branch guide 13, and floating collar 15, may be used to install and cement the well bore casing and drilling template in place. The cementing operation follows standard cementing practices for oil and gas well bore casing. The float collar 15, does not allow fluid passage from the well bore to the inside of the casing during installation. It, therefore, allows buoyancy to partially support the casing as it is lowered in the well bore. Fluid is sometimes added to the inside of the casing for negative buoyancy.

Once the well bore casing and drilling template have been completely inserted in the well bore, they can be cemented in the hole. A tieback tube 16 is inserted into the vertical branch guide 13 and filled with a cement slurry. A cement plug 11 is placed on top of the cement slurry and pumped down to the float collar forcing the cement up and around the well bore casing. The float collar valve 15 traps the cement which is allowed to harden around the casing.

Figure 3:
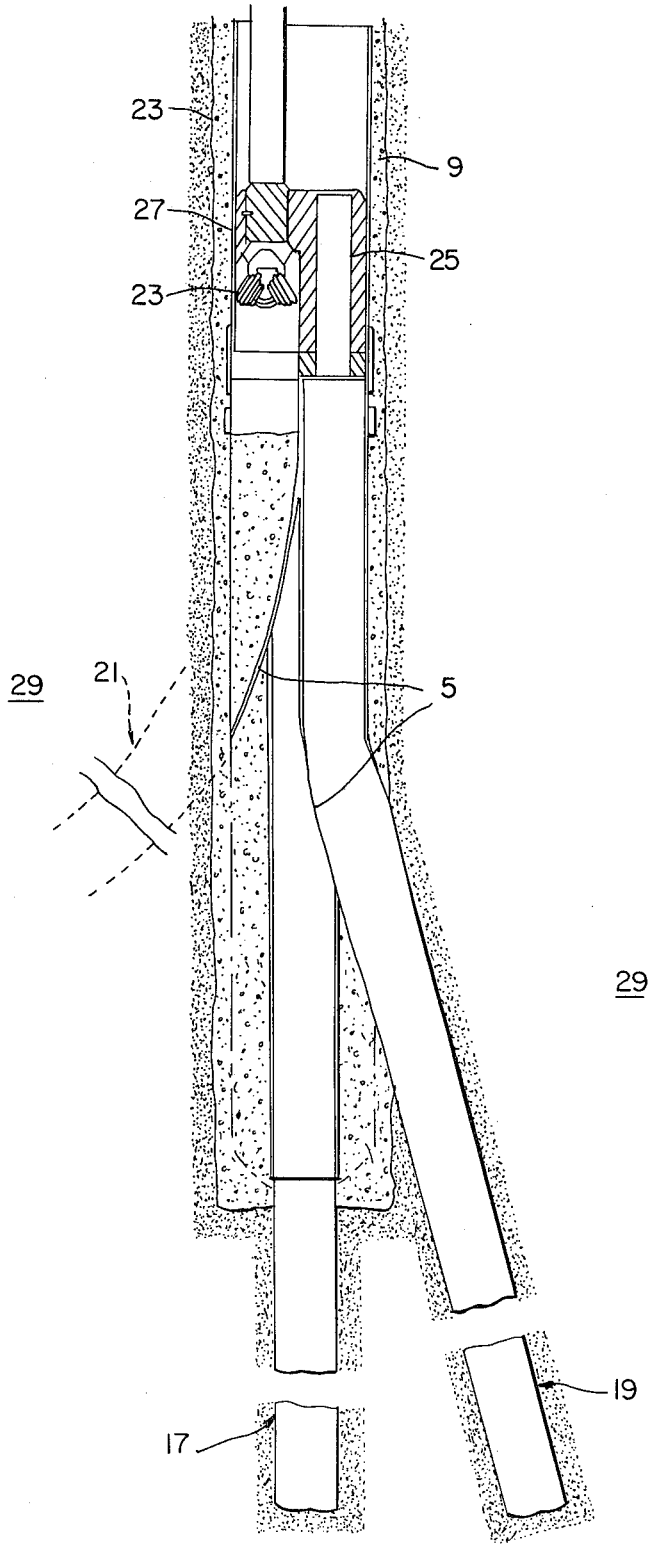
FIG. 3 illustrates schematically the third branch hole being drilled.

FIG. 3 depicts the FIG. 1 set up after two of the branch well holes 17 and 19 have been drilled. The third branch well hole 21 (shown in phantom lines) is about to be drilled from the surface by the drill bit assembly 23. The floating index collar 25 has a lower cut out portion which engages the indexing dog at point 27 to fix its orientation with respect to the stationary casing 3. This is the only figure which shows this collar. The collar acts as a guide through which the drill bit string moves to insure it drills to the proper whipstocked branch guide. The collar itself has three holes larger than the drill bit with each hole corresponding to the three branch wells. After the drill bit cuts through the hardening cement in each guide branch, it encounters the surrounding earth 29 and drills each branch well to its desired depth. Once the first branch well is drilled, the drill bit assembly and its associated collar 25 are retrieved to the surface and the drill bit is placed in another of the collar's holes. Then the second branch corresponding to that holes in the collar is drilled, the collar and bit retrieved, and the bit changed to the third hole of the collar. Finally, the third branch (21) corresponding to the third hole of the indexing collar is drilled. In each drilling sequence, the collar engages the fixed indexing dog and these two members are fixed in a horizontal plane with respect to the casing and oriented the same way with respect to each other. It is the surface changing of the drill bit's location in the collar which allows different branches to be sequentially drilled.

Figure 4:
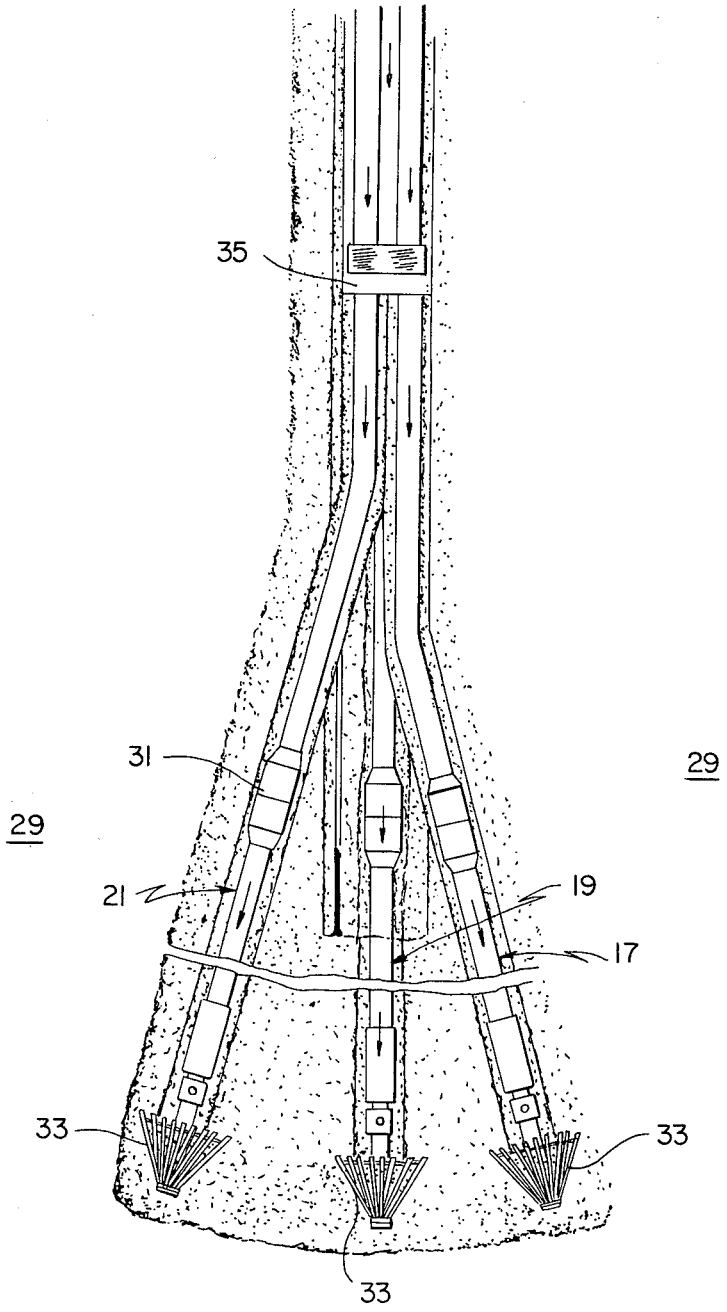
FIG. 4 depicts casings being applied to the branch wells.

FIG. 4 shows the FIG. 3 set up after all branch wells have been drilled; a casing 31 placed in each branch, and cement 9 inserted between the casing and branch well. The casing used in the branch wells is a string of flexible fiberglass pipes with a common triple tubing hanger for the three strings. Flexibility is necessary because of the bends and other irregularity possible with the drilled branch wells. Cement basket-like mechanical anchoring devices 33 are attached to the shoe or opened ends of each casing string to prevent the fiberglass pipe from floating as the heavy cement is circulated into the annulus. The drilling guides orient the casing into the branches and the three casing strings are simultaneously cemented. Thereafter, the triple tubing hanger 35 is set and cement is reversed above the hanger and the three branch casings are perforated.

Figure 5:
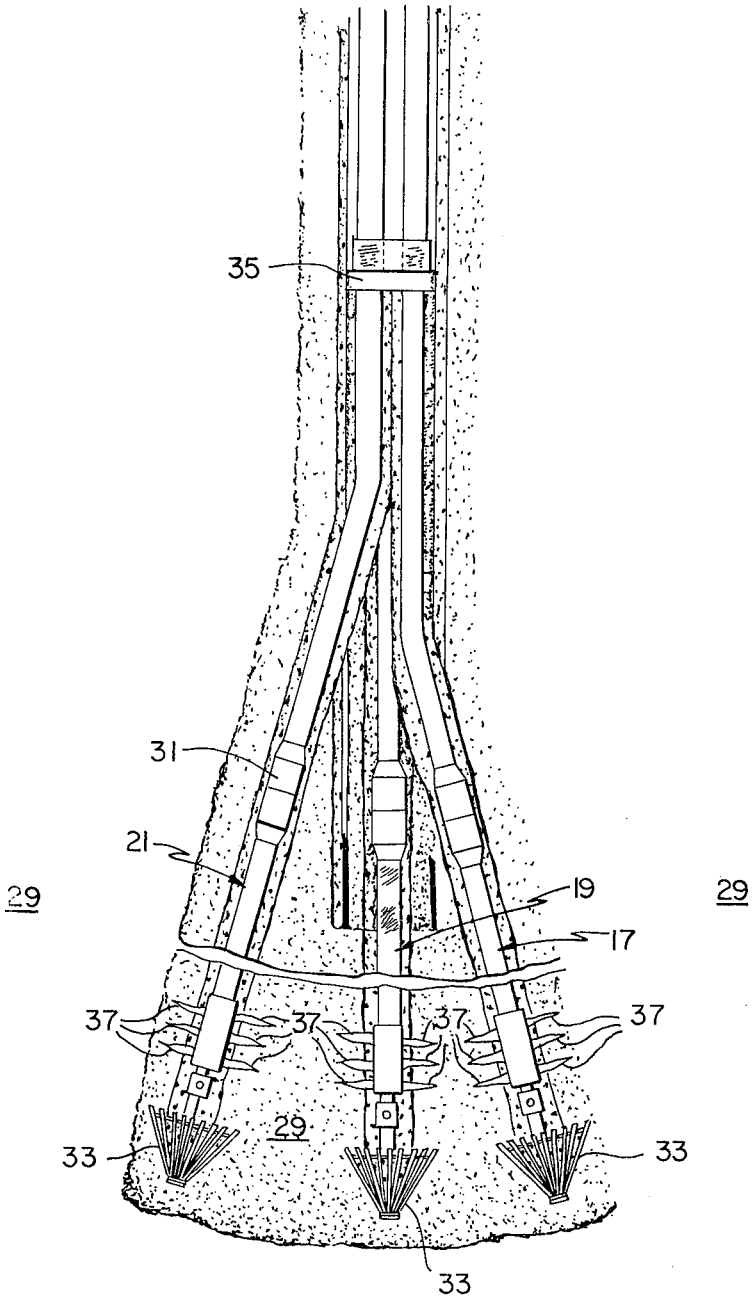
FIG. 5 shows the casings of the branch wells with perforations.

FIG. 5 illustrates the FIG. 4 system set in place with perforations 37 near the ends of the branch fiberglass casings. Several devices may be used to perforate the casings such as the water jet method disclosed in U.S. Pat. No. 4,113,314 by G. A. Savanick et al entitled "Well Perforating Method for Solution Well Mining." These perforations are cut in the casing at predetermined locations so that a leachant solution injected from the injection well flows through the recoverable mineral ore zone to the recovery (or production) well. It should be clear that although only the injection type of multiple branch well has been shown and disclosed herein but that our invention also includes producer or recovery wells.

Figure 6:
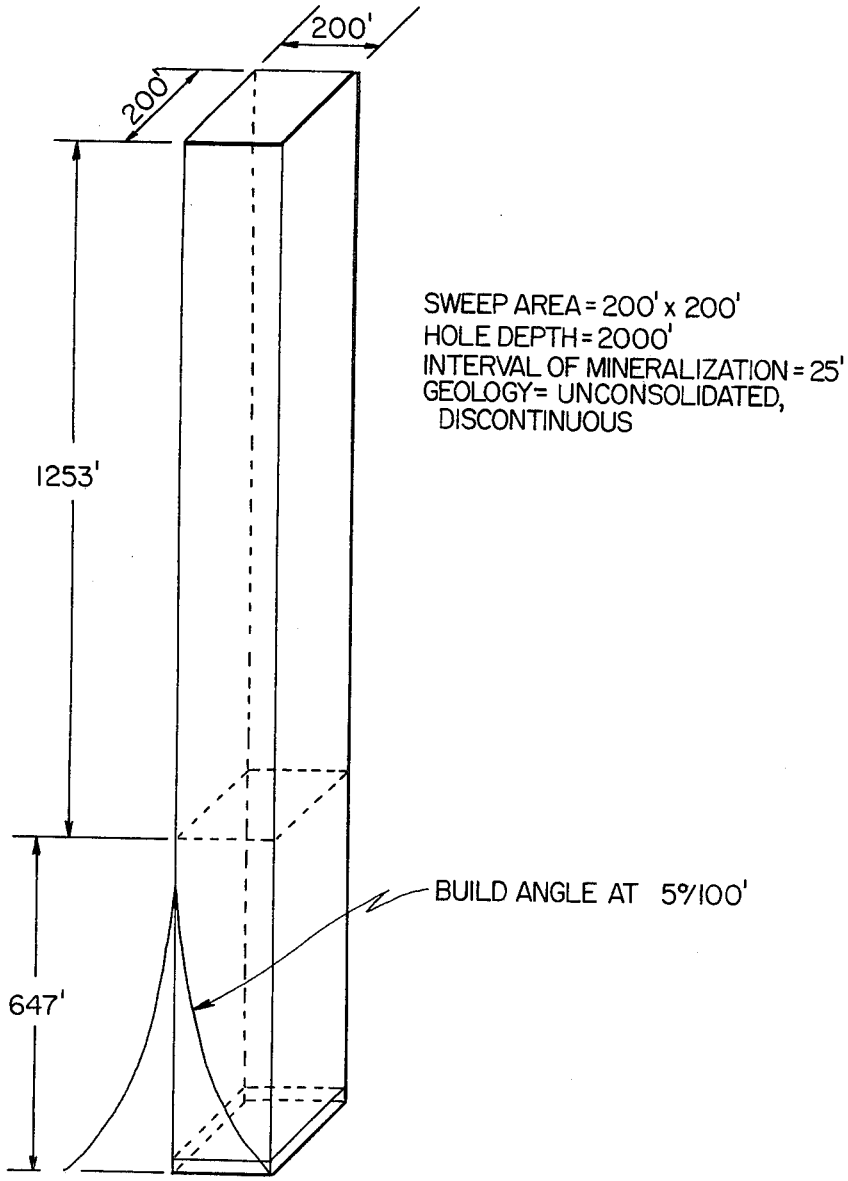
FIG. 6 is a schematic diagram of a typical branch well constructed according to the principles of this invention.

FIG. 6 depicts a schematic diagram of what may be considered the depth parameters for a more or less typical well constructed according to the principles of this invention. Our invention, of course, is in no way limited to this one example. Assuming prior exploration drilling and hydrologic testing has indicated that the wells should be placed to have a sweep surface area of 200 feet × 200 feet and the mineral bearing ore zone is about 2,000 feet deep, the schematic would be about as shown. The main generally vertical hole would be about 1,353 feet deep with the three branch wells extending another 647 feet from its bottom. These branches would extend at an angle or about 5 degrees for every 100 feet of branch length, have a radius of curvature of 1,147 feet, and have a measured depth (i.e. total casing length) of 2,040 feet. Each branch would have a true vertical depth of 2,000 feet and a branch arc length of 687 feet.

The numbers and specific design information illustrated exemplifies only one embodiment of our invention. Clearly many of its principles can be applied to other types of earth drilling operations such as oil and gas recovery and reservoir monitoring; in fact anywhere multiple branch wells could be utilized for the injection or recovery of liquids. They should not be used to restrict or otherwise change the scope and extent of our invention which is to be measured only by the claims which follow:

We claim:

1. A multiple branch well in the earth through which a liquid solution can pass comprising:

a generally vertical main cased hole;

drilling guide means attached to the bottom of said hole casing to provide a plurality of drilling guides for each of the branch wells to be drilled;

a drill bit assembly adapted to be lowered into said main hole and guided by the drilling guide into the branches to be drilled thereby;

a floating collar having a plurality of holes therein corresponding to the number of branch wells to be drilled, said collar being releasably engaged by the drill bit and adapted to fit into the main hole to allow the drill bit to move therethrough;

indexing means fixed in the casing above the drilling guide to allow the fixing of the orientation of the collar with respect to the casing when properly engaged with the collar whereby the drill bit can sequentially drill each of the branch holes after it is mounted; and a specific hole in the collar corresponding to a specific drilling guide for each of the respective branch wells.

2. The multiple branch well of claim 1 wherein the drilling guide is a plurality of tubular members extending down and outwardly from the lower end of the main hole casing.

3. The multiple branch well of claim 2 wherein the indexing means is an indexing dog made up of a protrusion, said protrusion being engaged by a member on the floating collar to fix the collar and indexing dot with respect to each other upon the application of a downward force thereto.

4. The multiple branch well of claim 1 wherein the indexing means and the collar are fixed with respect to each other upon the application of a downward force, said same two members being released from each other by the application of an upward force on the drill bit assembly from the surface.

5. The multiple branch well of claim 1 wherein each of the branch wells are cased with a flexible casing and cemented after drilling their respective branch holes.

6. The multiple branch well of claim 5 wherein the casing for each of the branch wells is made of a fiberglass material, said casings being perforated near their lower end to allow a leachant solution to pass therethrough.

* * * * *